US010900725B2

(12) United States Patent
Baert

(10) Patent No.: US 10,900,725 B2
(45) Date of Patent: Jan. 26, 2021

(54) BELT AMMUNITION FEEDING DEVICE FOR DUAL-FEED AUTOMATIC WEAPON

(71) Applicant: NEXTER SYSTEMS, Roanne (FR)

(72) Inventor: Steve Baert, Bourges (FR)

(73) Assignee: NEXTER SYSTEMS, Roanne (FR)

( * ) Notice: Subject to any disclaimer, the term of this patent is extended or adjusted under 35 U.S.C. 154(b) by 0 days.

(21) Appl. No.: 16/461,058

(22) PCT Filed: Nov. 10, 2017

(86) PCT No.: PCT/FR2017/053077
§ 371 (c)(1),
(2) Date: May 15, 2019

(87) PCT Pub. No.: WO2018/091805
PCT Pub. Date: May 24, 2018

(65) Prior Publication Data

US 2019/0310039 A1 Oct. 10, 2019

(30) Foreign Application Priority Data

Nov. 15, 2016 (FR) ..... 16 01620

(51) Int. Cl.
*F41A 9/56* (2006.01)
*F41A 9/30* (2006.01)
*F41A 9/37* (2006.01)

(52) U.S. Cl.
CPC ..... *F41A 9/56* (2013.01); *F41A 9/30* (2013.01); *F41A 9/37* (2013.01)

(58) Field of Classification Search
CPC ..... F41A 9/54; F41A 9/55; F41A 9/56; F41A 9/57; F41A 9/29; F41A 9/30; F41A 9/34; F41A 9/37
See application file for complete search history.

(56) References Cited

U.S. PATENT DOCUMENTS 1,038,555 A * 9/1912 Frommer ..... F41A 9/32 89/33.2
1,290,852 A * 1/1919 Sturgeon ..... F41A 3/32 89/184

(Continued)

FOREIGN PATENT DOCUMENTS

| | | |
|---|---|---|
| EP | 0129457 A1 | 12/1984 |
| FR | 3022338 A1 | 12/2015 |
| RU | 2406052 C1 | 12/2010 |

OTHER PUBLICATIONS

Feb. 9, 2018 International Search Report issued in International Patent Application No. PCT/FR2017/053077.

(Continued)

*Primary Examiner* — Derrick R Morgan
(74) *Attorney, Agent, or Firm* — Oliff PLC

(57) ABSTRACT

A belt ammunition feeding device for a dual-feed automatic weapon includes, for each feeding channel, at least a first rigid chute leading an ammunition belt from a magazine to the weapon, and a second rigid guide chute arranged at each tilting arm, the second chute including an upper mouth arranged opposite the outlet opening of the first rigid chute, the mouth also including a flared part forming a guide funnel and making it possible to cap the outlet opening of the first rigid chute when the tilting arm is in its engaged position with a stationary positioning star.

6 Claims, 4 Drawing Sheets

(56) References Cited

U.S. PATENT DOCUMENTS 1,784,355 A * 12/1930 Herlach ..... F41A 9/37 89/138
2,336,557 A * 12/1943 McCallister ..... B64D 7/02 89/37.17
2,363,219 A * 11/1944 Adamson ..... F41A 9/54 193/2 R
2,367,488 A * 1/1945 Dobremysl ..... F41A 3/32 89/33.2
2,380,773 A * 7/1945 McMullen ..... F41A 27/10 89/37.19
2,390,477 A * 12/1945 Trotter ..... F41A 9/51 89/33.5
2,391,888 A * 1/1946 Elliott ..... F41A 9/54 89/33.14
2,395,211 A * 2/1946 Bell ..... F41A 25/06 89/44.01
2,456,618 A * 12/1948 Carless ..... F41A 9/51 192/125 B
2,466,893 A * 4/1949 Holton ..... F41A 9/54 89/33.4
2,473,716 A * 6/1949 Lewis ..... F41A 9/57 193/25 AC
2,479,633 A * 8/1949 MacKenzie ..... F41A 9/54 89/33.14
2,569,798 A * 10/1951 Carroll ..... F41A 9/76 89/33.14
2,586,358 A * 2/1952 Maillard ..... F41A 9/56 89/33.1
2,610,549 A * 9/1952 Fonseca ..... F41A 9/29 89/33.14
2,649,840 A * 8/1953 Davidson, Jr. ..... F41A 9/54 89/33.16
2,752,024 A * 6/1956 Kolehmainen ..... F41A 9/57 193/25 AC
2,936,677 A * 5/1960 Vickers ..... F41A 9/54 89/33.16
3,017,808 A * 1/1962 Uhl ..... F41A 9/54 89/33.25
3,076,386 A * 2/1963 Wey ..... F41A 9/37 89/33.14
3,611,869 A * 10/1971 Hupp ..... F41A 9/37 89/33.04
3,618,454 A * 11/1971 Christenson ..... F41A 9/04 89/33.14
3,788,189 A * 1/1974 Sachleben, Sr. ..... F41A 9/34 89/34
3,901,123 A * 8/1975 Jayne ..... F41A 9/29 89/33.2
4,119,012 A * 10/1978 Frye ..... F41A 9/37 89/33.04
4,416,185 A * 11/1983 Schenk ..... F41A 9/37 89/33.04
4,562,768 A * 1/1986 Weinfurth ..... F41A 9/60 89/33.04
4,612,843 A * 9/1986 Marcon ..... F41A 9/37 89/33.04
4,881,447 A * 11/1989 Yanusko ..... F41A 9/82 89/34
5,299,487 A * 4/1994 Bertiller ..... F41A 9/56 89/1.41
5,782,157 A * 7/1998 Ellington ..... F41A 9/29 193/25 AC
6,622,606 B1 * 9/2003 Neal ..... F41A 9/34 42/90
10,132,581 B2 * 11/2018 Chachamian ..... F41A 9/34
2003/0177896 A1 * 9/2003 Dionne ..... F41A 9/54 89/33.2
2015/0153123 A1 * 6/2015 Chachamian ..... F41A 9/34 89/33.2
2019/0264996 A1 * 8/2019 Baert ..... F41A 23/24

OTHER PUBLICATIONS

Feb. 9, 2018 Written Opinion issued in International Patent Application No. PCT/FR2017/053077.
Jun. 30, 2017 Search Report and Written Opinion issued in French Patent Application No. 1601620.

* cited by examiner

BELT AMMUNITION FEEDING DEVICE FOR DUAL-FEED AUTOMATIC WEAPON

The technical field of the invention is that of devices for feeding belt ammunition to an automatic weapon, and more particularly that of devices intended for weapons having a dual feed.

It is conventional to feed a weapon from ammunition belts. To avoid firing incidents, the ammunition belts are generally guided by chutes.

The chutes are most often flexible or semi-rigid chutes. However, when the weapon seating is compact and one seeks to lead the belts along paths having a smaller curve radius, it is necessary to use rigid chutes. Indeed, the natural curvature adopted by the flexible or semi-rigid chutes does not make it possible to reduce the bulk of the chutes. Furthermore, the flexible chutes are poorly adapted to paths combining or alternating different pivoting of the belt.

This is true in particular when it is necessary to pivot the belt by 90° to lead the ammunition from a magazine in which it is oriented with its axis perpendicular to the vertical plane containing the axis of the tube of the weapon toward an orifice for insertion into the weapon at which the ammunition has its axis parallel to the axis of the tube of the weapon.

Patent U.S. Pat. No. 5,299,487 describes a multi-tube weapon system that is thus fed by rigid chutes.

However, this weapon system is a multi-tube system concretely including several weapons each having its insertion orifice. Each rigid chute is therefore fastened at the insertion orifice in one of the weapons and it is provided to produce a chute having two rectilinear parts sliding relative to one another to absorb the recoil of the weapon. Recoil for a medium-caliber weapon is around 10 to 30 mm (a medium caliber refers to a caliber of between 12.5 mm and 40 mm).

Such a solution cannot be implemented for a single-tube weapon whereof the feeding device comprises two feeding channels intended to convey different ammunition. Such a weapon and its feeding device are for example described in patent EP 129,457. With such a device, the ammunition belt that is not used is moved away from the weapon and it is therefore not possible to fasten a rigid chute to each ammunition feed.

It is the aim of the invention to propose a feeding device for a weapon including two tilting feeding channels, the device including rigid chutes making it possible to ensure the compactness of the seating while ensuring a reliable guiding of the ammunition belts.

The invention thus relates to a belt ammunition feeding device for a dual-feed automatic weapon, the device comprising two ammunition feeding channels that are arranged on either side of a firing axis of the weapon, each channel being provided with an arm tilting around an axis parallel to the axis of the weapon so as to be able to position a feeding star secured to said tilting arm between a position engaged with a stationary positioning star and a position free from the stationary positioning star, the device being characterized in that it comprises, for each feeding channel, at least a first rigid chute leading an ammunition belt from a magazine to the vicinity of the weapon, and at each tilting arm, a second rigid guide chute including an upper mouth connected to a straight part in which the ammunition is guided and progresses with its axis substantially parallel to the firing axis and along a substantially vertical direction, the mouth being oriented along a direction substantially perpendicular to the straight part and being arranged opposite an outlet opening of the first rigid chute, the mouth also including a flared part forming a guide funnel and making it possible to cap the outlet opening of the first rigid chute when the tilting arm is in its position engaged with the stationary positioning star.

According to one feature, the flared part of the mouth can make it possible to cap the outlet opening of the first rigid chute also when the tilting arm is in its position free from the stationary positioning star.

Advantageously, the mouth can include a recess at its upper face.

According to other features, the first rigid chute can include a part forming a flat bend of 90° so as to lead the ammunition from an initial orientation in which it has its axis perpendicular to a vertical plane passing through the axis of the weapon to a final orientation, at the outlet opening of the first rigid chute, in which final orientation the axis of the ammunition is parallel to the axis of the weapon.

Each tilting arm can comprise a lower part secured to the weapon and to which the second rigid chute will be fastened by a deformable parallelogram.

The invention will be better understood upon reading the following description of one particular embodiment, the description being done in reference to the appended drawings and in which.

Figure 4A:
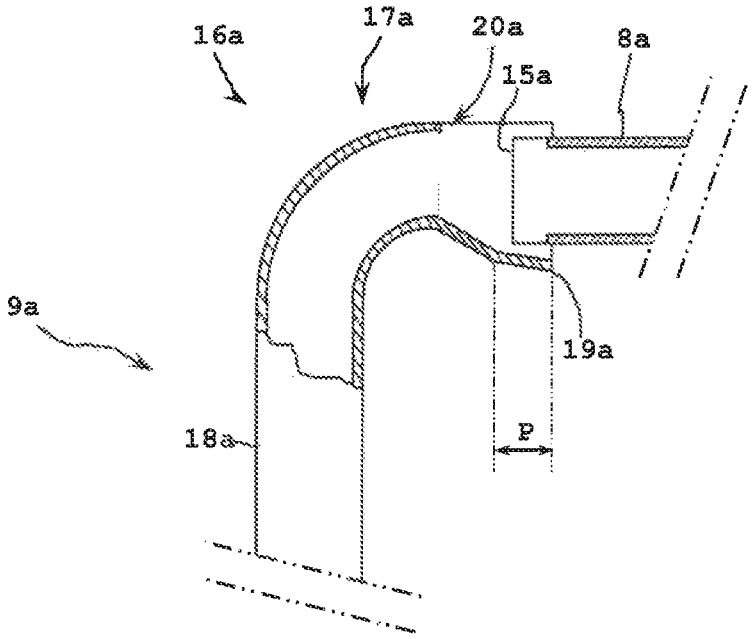
Figure 4B:
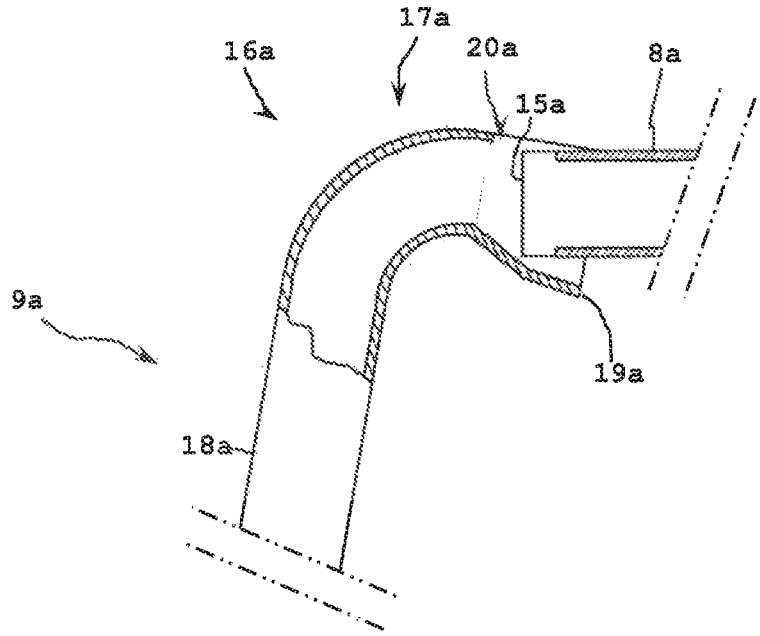

FIG. 4*a* is a partial view showing the feeding device in the freed position;

FIG. 4*b* is a partial view showing the feeding device in the engaged position.

Figure 1:
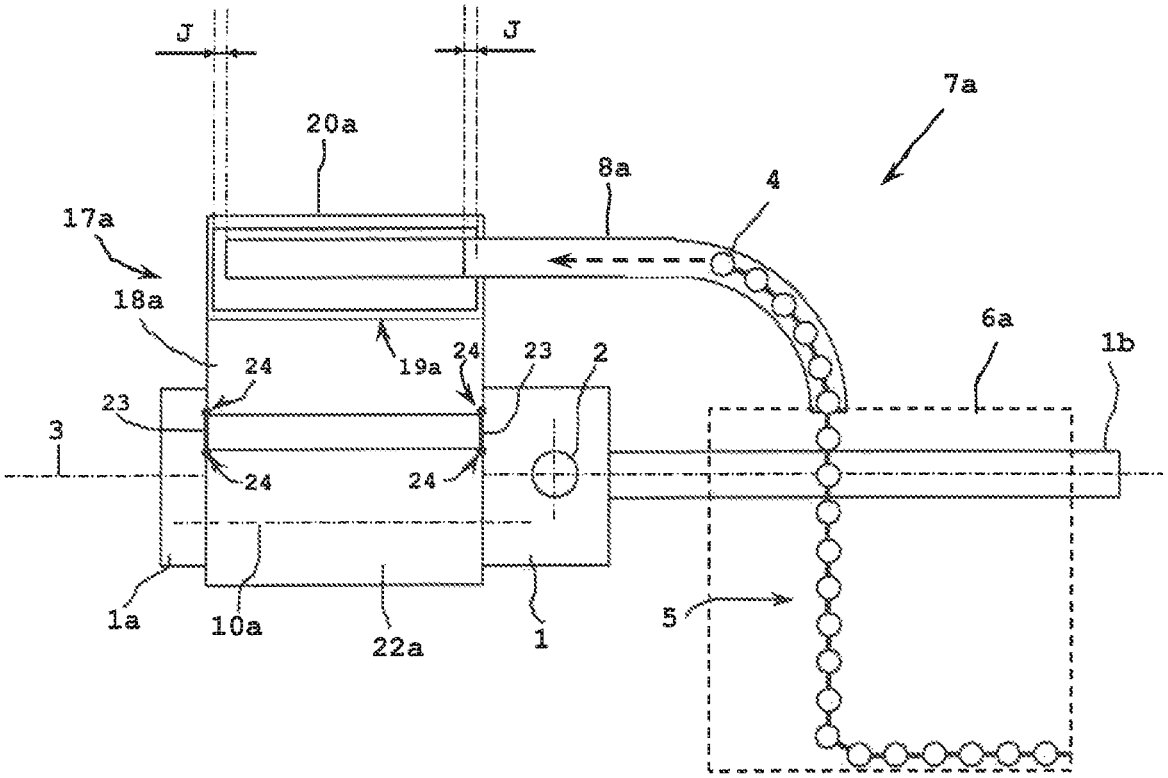
FIG. 1 is a schematic side view of a weapon and its ammunition feeding device.
Figure 2:
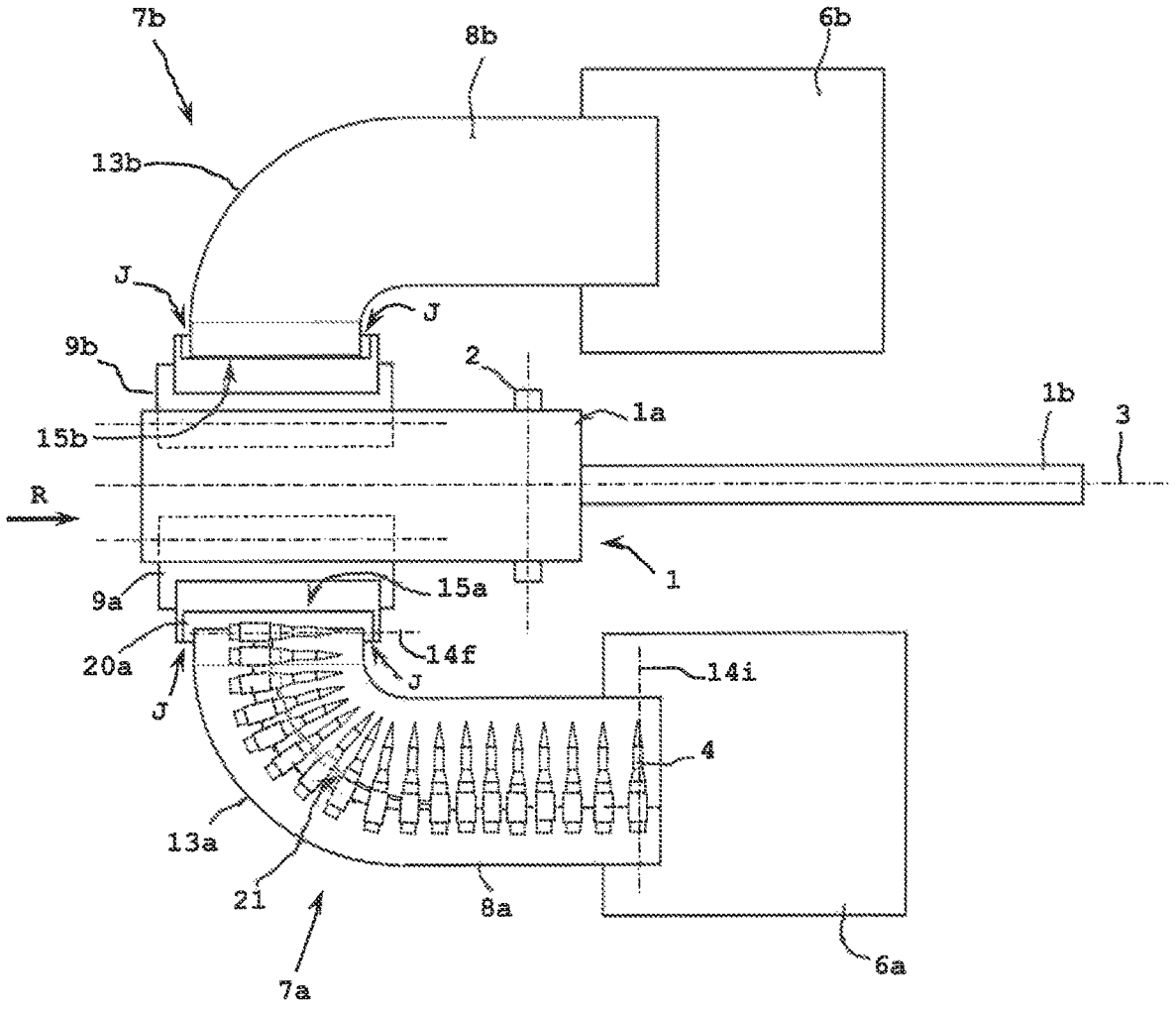
FIG. 2 is a top view of this weapon and its feeding device.

In reference to FIGS. 1 and 2, a medium-caliber automatic weapon 1 (caliber of between 12.5 mm and 40 mm) includes a weapon mechanism 1*a*, secured to a sled allowing the recoil (not shown in detail) and a tube 1*b*. The sled of the weapon 1 is secured to an oscillating support (not shown) that can pivot on journals 2 relative to a carriage (not shown) to allow elevation aiming. The firing axis 3 of the weapon is shown in mixed dotted lines.

As shown more particularly in FIG. 2, the weapon 1 is of the type with a dual feed (as described by patent EP 129,457), and the feeding device therefore comprises two channels 7*a* and 7*b* for feeding ammunition 4 that are arranged on either side of the firing axis 3 of the weapon 1. At each channel 7*a* or 7*b*, the ammunition 4 is connected as a belt 5 (FIG. 1) that is housed in a magazine 6*a* or 6*b* arranged laterally with respect to the weapon.

As shown in the Figures, the feeding device comprises, at least channel 7*a* or 7*b*, a first rigid chute 8*a* or 8*b* that leads a belt of ammunition 4 from the magazine 6*a* or 6*b* to the vicinity of the weapon 1.

Figure 3:
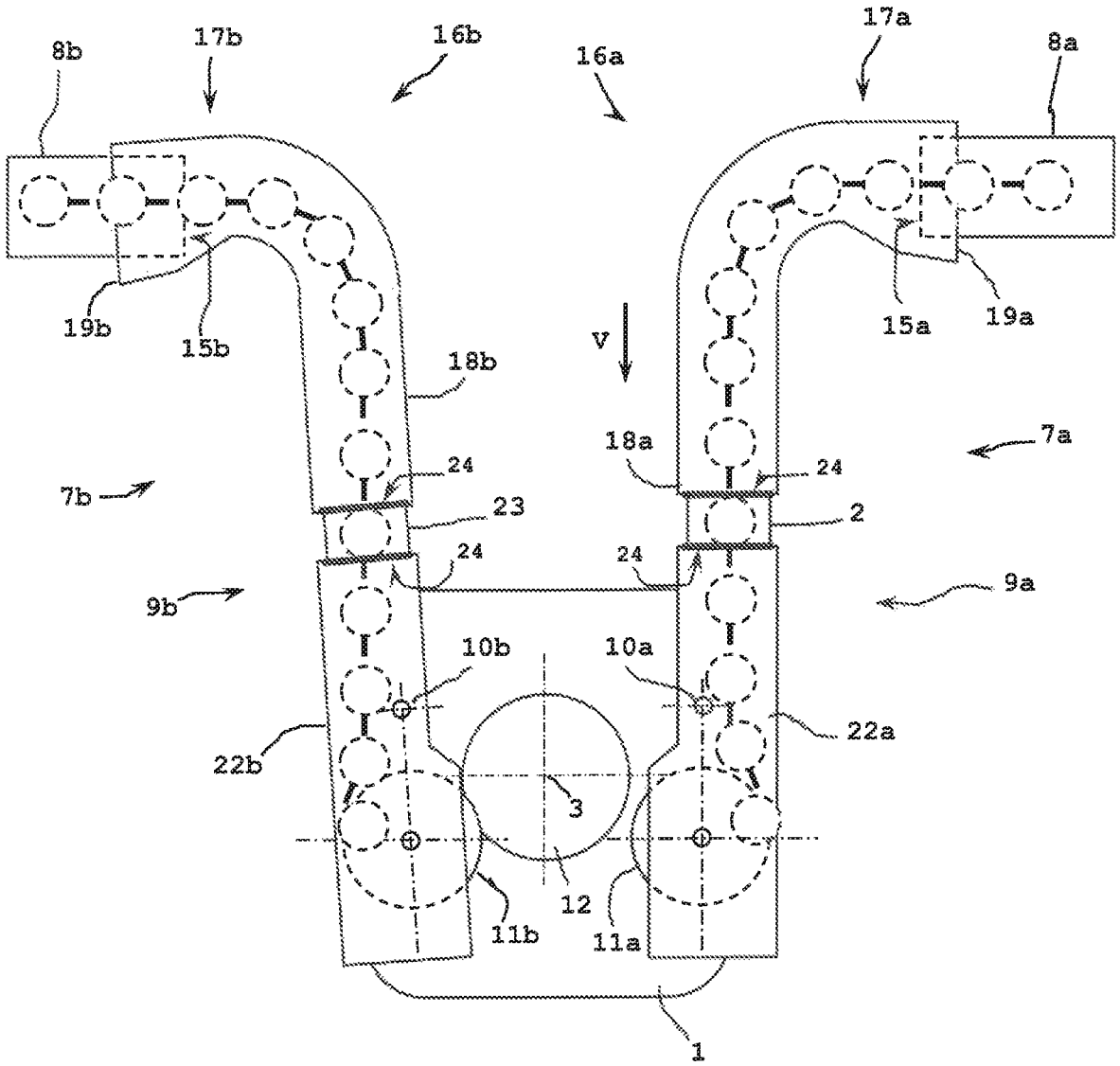
FIG. 3 is a simplified rear view, along arrow R identified in FIG. 2, and showing the dual-feed feeding device.

FIG. 3 schematically shows the weapon 1 at the orifices for insertion of the ammunition. As described in patent EP 129,457, each channel 7*a*, 7*b* is provided with an arm 9*a* or 9*b* that tilts around an axis 10*a* or 10*b* that is parallel to the axis 3 of the weapon. Each arm can thus position a feeding star 11*a* or 11*b* in a position engaged with a stationary positioning star 12 carried by the weapon or in a position disengaged from the stationary position star 12. Each star 11*a* or 11*b* is secured to one of the tilting arms 9*a* or 9*b*.

For the simplicity of the Figures, the stars have not been drawn with all of the cells. This device is described by patent EP 129,457, to which reference will be made for the construction details.

The right tilting arm 9*a* here is shown freed from the stationary star 12. The left tilting arm 9*b* is shown engaged with the stationary star 12. This position corresponds to feeding of the arm 1 with the ammunition coming from the left arm 9*b*.

According to this embodiment of the invention, each feeding channel 7*a* and 7*b* therefore comprises a first rigid chute 8*a*, 8*b* that includes a part forming a flat bend 13*a*, 13*b* of 90° (FIG. 2). This bend makes it possible, as shown in FIG. 2, to bring the ammunition 4 from an initial orientation in which it has its axis 14*i* perpendicular to a vertical plane passing through the axis 3 of the weapon to a final orientation in which the ammunition has its axis 14*f* parallel to the axis 3 of the weapon.

The ammunition 4 is in the initial orientation of its axis 14*i* at the magazines 6*a*, 6*b* and in the straight part of the first rigid chute 8*a*, 8*b*. The ammunition 4 is in the final orientation of its axis 14*f* at an outlet opening 15*a* or 15*b* of the first rigid chute 8*a*, 8*b*.

To improve the guiding of the belts of ammunition 4 during this pivoting by 90° in the first rigid chutes 8*a*, 8*b*, the bottoms of the first rigid chutes 8*a*, 8*b* bear one or several rigid bars 21 that have a circular profile and that cooperate with the links of the belts to ensure guiding of the belts.

The device according to the invention also comprises, at each tilting arm 9*a*, 9*b*, a second rigid guide chute 16*a*, 16*b* that includes an upper mouth 17*a*, 17*b* that is connected to a straight part 18*a*, 18*b* in which the ammunition 4 is guided and progresses with its axis substantially parallel to the firing axis 3 and along a substantially vertical direction V (FIG. 3).

The mouth 17*a* or 17*b* is oriented along a direction substantially perpendicular to the straight part 18*a* or 18*b* and is arranged opposite the outlet opening 15*a* or 15*b* of the first rigid chute 8*a* or 8*b*.

As shown in FIG. 3, the mouth 17*a* (or 17*b*) includes a flared part 19*a* or 19*b* forming a guide funnel and making it possible to cap the outlet opening 15*a* or 15*b* of the first rigid chute 8*a* or 8*b* when the tilting arm 9*a* or 9*b* is in its position engaged with the stationary positioning star 12.

One can see in FIG. 3 that each arm 9*a*, 9*b* includes a lower part 22*a* or 22*b* that bears the articulation 10*a* or 10*b* and on which the straight part 18*a* or 18*b* of the second chute 16*a* or 16*b* is fastened. The fastening is done by two plates 23 that are arranged at the narrow sides of the chute (see also FIG. 1) and that are articulated both on the straight part 18*a* or 18*b* and on the lower part 22*a* or 22*b* (articulations 24 shown schematically by lines in FIG. 3). These two plates constitute a deformable parallelogram connecting the second rigid chute 16*a* or 16*b* to the lower part 22*a*, 22*b* of the arm 9*a* or 9*b*. This deformable parallelogram allows a limited axial movement of the weapon 1 (which is secured to the lower part 22*a*, 22*b* of the arms) relative to the second rigid chutes 16*a*, 16*b* that are maintained relative to the carriage. This allows the recoil of the weapon despite the presence of rigid chutes. The recoil is about 10 to 30 mm for medium-caliber automatic weapons.

As shown in FIGS. 1 and 2, the mouth 17*a* or 17*b* also has a transverse clearance J relative to the first rigid chute 8*a* or 8*b*. Such overall clearance is about 10 mm. It is distributed on either side of the rigid chute 8*a* or 8*b* and allows the tilting without interference from the second rigid chute 16*a*, 16*b* relative to the first rigid chute 8*a*, 8*b*.

Thus, the guiding of the ammunition is fully ensured by the rigid chutes both at the first rigid chute 8*a*, 8*b* and the second rigid chute 16*a*, 16*b*. The guiding is also ensured between the second rigid chute 16*a*, 16*b* and the lower part 22*a*, 22*b* of the arms. There is no risk of seeing the ammunition belt deform or twist near the weapon, despite the compactness of the feeding device and the 90° pivoting of the ammunition that is ensured in the immediate vicinity of the weapon.

It will be noted that the rigid chutes 8*a*, 8*b*, 16*a* and 16*b* are connected to the oscillating support of the weapon 1 by means that are not shown and they therefore pivot with this support during elevation aiming.

FIGS. 4*a* and 4*b* show the upper part of the right feeding channel 7*a*, showing the second rigid chute 16*a* and its cooperation with the first rigid chute 8*a*. It is clear that the figure would be similar for the left feeding channel 7*b*, which is symmetrical to the right feeding channel relative to the vertical plane passing through the axis 3 of the tube of the weapon.

As shown more particularly in FIGS. 4*a* and 4*b*, the mouth 17*a* (or 17*b*) can cap the outlet opening 15*a* (or 15*b*) of the first rigid chute 8*a* (or 8*b*) both in the engaged position of the tilting arm (FIG. 4*b*) and in the freed position of the tilting arm (FIG. 4*a*). Such an arrangement guarantees that the ammunition 4 of the belt is always positioned inside a rigid chute. The depth P of the flared part 19*a* (or 19*b*) will be sufficient to perform such a function. It will also be noted in FIGS. 4*a* and 4*b* that the mouth 17*a* (or 17*b*) includes a recess 20*a* (or 20*b*) at its upper face. Such an arrangement, associated with the presence of the flared part 19*a* (or 19*b*), allows a tilting of the arm without interference with the first rigid chute 8*a* (or 8*b*).

The recess 20*a* or 20*b* also makes it possible to access the ammunition belt to be able to push it manually during the initial loading.

Various alternatives are possible without going beyond the scope of the invention. It is thus possible to make the deformable parallelogram connecting the lower part of the tilting arm to the second rigid chute in the form of connecting rods connected to the two parts of the arm by ball joint links.

The invention claimed is:

1. A belt ammunition feeding device for a dual-feed automatic weapon, the device comprising two ammunition feeding channels that are arranged on either side of a firing axis of the weapon, each channel being provided with an arm tilting around an axis parallel to a firing axis of the weapon so as to be able to position a feeding star secured to said tilting arm between a position engaged with a stationary positioning star and a position free from the stationary positioning star, wherein the device comprises, for each feeding channel, at least a first rigid chute leading an ammunition belt from a magazine to a vicinity of the weapon, and at each tilting arm, a second rigid guide chute including an upper mouth connected to a straight part, wherein, in the straight part the ammunition is guided and progressing with an axis of the ammunition substantially parallel to the firing axis of the weapon and along a substantially vertical direction, wherein the mouth is oriented along a direction substantially perpendicular to the straight part and is arranged opposite an outlet opening of the first rigid chute, wherein the mouth also includes a flared part that forms a guide funnel, the flared part of the mouth being configured to cap the outlet opening of the first rigid chute when the feeding star secured to the tilting arm is in the position engaged with the stationary positioning star.

2. The device according to claim 1, wherein the flared part of the mouth is configured to cap the outlet opening of the first rigid chute also when the feeding star secured to the tilting arm is in the position free from the stationary positioning star.

3. The device according to claim 1, wherein the mouth includes a recess at an upper face of the mouth.

4. The device according to claim 1, wherein the first rigid chute includes a part forming a flat bend of 90° so as to lead the ammunition from an initial orientation in which the axis of the ammunition is perpendicular to a vertical plane passing through the firing axis of the weapon to a final orientation, at the outlet opening of the first rigid chute, in which final orientation the axis of the ammunition is parallel to the firing axis of the weapon.

5. The device according to claim 1, wherein each tilting arm comprises a lower part secured to the weapon, the second rigid chute being fastened to the lower part by a deformable parallelogram, and wherein the deformable parallelogram is in two plates that are articulated both on the straight part and on the lower part.

6. The device according to claim 1, wherein each tilting arm comprises a lower part secured to the weapon, the second rigid chute being fastened to said lower part by a deformable parallelogram, wherein said deformable parallelogram includes connecting rods connected to the second rigid chute and to the lower part by ball joint links.

* * * * *